United States Patent [19]

Ogoshi et al.

[11] 4,129,526

[45] Dec. 12, 1978

[54] GRANULAR DETERGENT COMPOSITIONS AND A PROCESS FOR PRODUCING SAME

[75] Inventors: Toshiaki Ogoshi, Funabashi; Masayoshi Nakamura, Koshigaya; Mituyoshi Yazaki, Yachiyo, all of Japan

[73] Assignee: The Lion Fat & Oil Co., Ltd., Tokyo, Japan

[21] Appl. No.: 815,849

[22] Filed: Jul. 14, 1977

[51] Int. Cl.[2] ..... C11D 3/34

[52] U.S. Cl. ..... 252/536; 252/135; 252/174; 252/531; 252/532; 252/555

[58] Field of Search ..... 252/536, 532, 531, 555, 252/135, 174

[56] References Cited

U.S. PATENT DOCUMENTS

| | | | |
|---|---|---|---|
| 3,755,203 | 8/1973 | Bentley et al. | 252/536 |
| 3,951,877 | 4/1976 | Okumura et al. | 252/536 X |

*Primary Examiner*—Mayer Weinblatt

*Attorney, Agent, or Firm*—William J. Daniel

[57] ABSTRACT

Granular detergent compositions with improved powder characteristics and good detergency are obtained by adjusting the proportion of an α-olefinsulfonate in anionic surfactants to 15–50% by weight, selecting the molar ratio of a silicate in terms of $M_2O.xSiO_2$ wherein M stands for an alkali metal within the range of 2.5–3.6 and limiting the amount of an alkali metal sulfate to 4% or less in detergents containing builders comprising mainly silicates, carbonates and hydroxypolycarboxylates but being free of a polyphosphate.

6 Claims, No Drawings

GRANULAR DETERGENT COMPOSITIONS AND A PROCESS FOR PRODUCING SAME

BACKGROUND OF THE INVENTION

The present invention relates to granular detergent compositions which are excellent in powder characteristics (physical properties of granules) but are free from phosphorus. More particularly, the present invention relates to granular detergent compositions free from phosphorus which are improved in powder characteristics such as compression-caking and free flowability.

From the past, sodium tripolyphosphate has chiefly been used as a builder for granular detergents. Sodium tripolyphosphate is not only excellent in detergency-improving action but also effective to improve the powder characteristics of the resultant granular detergents and thus affords detergents with well balanced properties when used in combination with sodium sulfate as bulking agent.

In recent years, however, environmental pollution has become a big social problem and the use of such polyphosphates has been identified as one of the causes of water pollution and thus restricted in use considerably. For this reason, builders which were formerly only in limited use, such as carbonates, silicates or citrates, are being substituted in place of the polyphosphates.

However, granular detergents prepared by using these builders have disadvantages; they tend to become caked upon compression, thus incurring deterioration of important powder characteristics such as free flowability. In the industry of manufacturing granular detergents, therefore, there is a great demand for development of an auxiliary additive which can afford, without necessity of using polyphosphates, high detergency combined with powder characteristics comparable with the case of using polyphosphates.

As a result of extensive researches made for meeting such requirement, it has now been found that the powder characteristics as well as detergency are better improved as the amount of an alkali sulfate becomes smaller when a specific composition of an anionic surfactant is selected and the molar ratio x of a silicate in term of $M_2O.xSiO_2$ wherein M stands for an alkali metal is also selected within the range of 2.5–3.6 in detergents containing builders comprising mainly silicates, carbonates and hydroxypolycarboxylates. The present invention is based on this finding.

BRIEF SUMMARY OF THE INVENTION

In accordance with the present invention, there is provided a detergent composition which comprises 20–35% by weight of anionic surfactants, 10–20% by weight of an alkali metal silicate, 25–60% by weight of an alkali metal carbonate and 1–20% by weight of an alkali metal hydroxypolycarboxylate and is substantially free from a phosphate, characterized in that (a) 15–50% by weight of the anionic surfactants is an α-olefinsulfonate with the balance being an alkyl ether sulfate and an alkyl sulfate, (b) the molar ratio x of the alkali metal silicate in terms of $M_2O.xSiO_2$ wherein M stands for an alkali metal is 2.5–3.6 and (c) the content of an alkali metal sulfate is limited to at most 4% by weight as well as a process for producing same.

Accordingly, it is an object of the present invention to provide a phosphate-free granular detergent composition which is improved in the powder characteristics such as compression-caking and free flowability.

It is another object of the present invention to provide a granular detergent composition which exhibits, without the necessity of using polyphosphates, high detergency and powder characteristics comparable with the case of using polyphosphates.

It is still another object of the present invention to provide a process suitable for producing a phosphate-free granular detergent composition which is improved in the powder characteristics such as compression-caking and free flowability and is excellent in detergency.

Other and further objects, features and advantages of the present invention will appear more fully from the following description.

DETAILED DESCRIPTION OF THE INVENTION

The anionic surfactants used in the present invention are those conventionally used for detergents. Examples of such surfactants include sodium, potassium and magnesium salts of α-olefinsulfonic acids with 12–20 carbon atoms; sodium, potassium and magnesium salts of alkyl ether sulfuric acids (AES) with 8–18 carbon atoms and an average molar ratio of ethylene oxide (EO) within a range of 1–5; and sodium, potassium and magnesium salts of alkylsulfuric acids with 9–16 carbon atoms. The anionic surfactants are incorporated properly in an amount of 20–35% by weight (all percentages given hereinafter will be based on weight). If the amount of the anionic surfactant exceeds 35%, the powder characteristics of the resultant detergent composition will deteriorate. On the other hand, if the amount is less than 20%, the detergency will suffer. It is necessary that 15–50% of the anionic surfactant be an α-olefinsulfonate with the balance being an alkyl ether sulfate and an alkyl sulfate. If the proportion of the α-olefinsulfonate in the anionic surfactant content exceeds 50%, the detergent will be difficult to rinse off. On the other hand, if the proportion is less than 15%, the powder characteristics of the detergent will deteriorate.

By the term "α-olefinsulfonates" used herein is meant a mixture of olefinsulfonates obtained by sulfonation of a commercially available α-olefin feed. The α-olefinsulfonates are in the form of a mixture of various compounds including hydroxyalkanesulfonates in addition to various disulfonates and a large proportion of alkenesulfonates. A detailed explanation on the sorts and amounts of various constituents usually contained in α-olefinsulfonates is given in the specification of U.S. Pat. No. 3,332,880.

The commercially available α-olefin feed is generally produced by the cracked wax method wherein olefins are extracted from a cracked paraffin fraction or by the Ziegler method wherein olefins are prepared by polymerization of unsaturated low molecular weight hydrocarbons such as ethylene using a Ziegler catalyst or like catalysts. Such olefins may be prepared through another route by dehydrogenation of paraffins or by dehydration of primary alcohols produced by hydrogenation of natural fatty acid esters obtained, for example, by saponification of animal fats and oils. Olefinsulfonates prepared from the so-called Ziegler olefins are preferably used for the purpose of this invention because the Ziegler olefins normally comprise about 90% of α-olefins and a very small amount of substances with side branches. The cracked wax olefins are also suitable because they contain about 85–90% of α-olefins along with a small amount of internal olefins and diolefins. α-Olefins used for the preparation of α-olefinsulfonates utilizable in the present invention preferably contains linear α-olefins as high in proportion as possible. An olefin feed composed of 100% α-olefins is indeed ideal but such feed cannot be obtained according to the existing technique.

In the present invention, the alkali metal silicate is added in an amount of 10–20%. If the amount is less than 10%, it will be difficult to obtain granule strength necessary for the detergent granules. On the other hand, if the amount exceeds 20%, insoluble substances will be formed by the influence of carbon dioxide in the air, which substances will decrease solubility of the granular detergent. The alkali metal silicate utilizable in the present invention is represented by the general formula: $M_2O.xSiO_2$ wherein M stands for an alkali metal and x for a number within the range of 2.5–3.6. If the value of x exceeds 3.6, workability in the production of the detergent composition will become bad. On the other hand, if the value is less than 2.5, the powder characteristics will deteriorate.

The alkali metal carbonate is used in an amount of 25–60%. Examples of the alkali metal carbonate include alkali metal carbonates per se, sesquicarbonates and bicarbonates among which the bicarbonates are advantageously used also for the purpose of adjusting pH of the cleansing liquid moderately. The bicarbonates are preferably added as particles to spray-dried granular detergent rather than adding to a slurry for preparing the detergent. The amount of the bicarbonate added is preferably 3–15% based on the total composition.

The hydroxypolycarboxylate is added in an amount of 1–20% as an organic builder possessing sequestering activity. On addition of the hydroxypolycarboxylate to the composition, the former is added in the form of a hydroxypolycarboxylic acid to a slurry comprising an anionic surfactant and an alkali metal silicate whereby the salt is formed in the slurry and at the same time the molar ratio x of the alkali metal silicate is adjusted to a desired value. The hydroxypolycarboylate added in this manner can improve the powder characteristics of the granular detergent composition. No appreciable improvement in the powder characteristics is observed by the use of other inorganic or organic acid salt in place of the hydroxypolycarboxylate. Utilizable as the hydroxypolycarboxylic acid are, for example, citric acid, malic acid and tartaric acid.

As the alkali metal sulfate impairs the powder characteristics, the amount thereof is preferably as small as possible. However, contamination of the detergent composition with the alkali metal sulfate in an amount of 1–2% is unavoidable since a small amount of the alkali metal sulfate is usually formed as by-product during the production of the anionic surfactant. As the undesirable influence of the alkali metal sulfate is substantially negligible at a concentration of 4% or less, the content of the alkali metal sulfate is limited in the composition of the present invention to at most 4%.

The detergent composition of the present invention is prepared by mixing the anionic surfactants, the alkali metal silicate and the hydroxypolycarboxylate with a dispersion medium comprising water alone or a mixture of water and an alcohol to form a slurry containing solids comprising the above three constituents and having a solid content of about 55–60% and subjecting the slurry to spray-drying according to a conventional method. During this process, the hydroxypolycarboxylic acid is reacted with the alkali metal silicate to form a salt of the acid and at the same time the molar ratio x of the alkali metal silicate is adjusted to 2.5–3.6. For this purpose, the ratio of the alkali metal silicate to the hydroxypolycarboxylic acid in the slurry is properly adjusted within the range from 10:1 to 3:1.

Other constituents may also be added to the slurry or may be added after the slurry has been spray-dried.

The composition of the present invention may include a small amount of other components such as a further anionic surfactant, such as an alkylbenzensulfonate or a soap, an amphoteric surfactant of, for example, betaine-type or amino acid type, and/or a non-ionic surfactant such as a polyoxyethylene alkyl ether. One or more redeposition-preventing agents, fluorescent brightening agents, perfumes and coloring agents may also be incorporated into the composition, if necessary.

The granular detergent composition of the present invention possesses satisfactory detergency and good powder characteristics so that the composition is excellent in free flowability and is not caked nor conglomerated by compression, notwithstanding the absence of any polyphosphate.

The present invention will now be illustrated in more detail by way of example.

EXAMPLES 1–9

A mixture of anionic detergents and sodium silicate was incorporated with citric acid and minor components such as sodium carbonate, a redeposition-preventing agent and a fluorescent brightening agent and the mixture was then mixed well to form a slurry having a solid content of about 60%. The slurry was subjected to spray drying to prepare a detergent composition tabulated in Table 1. Sodium bicarbonate was admixed as particles with the spray-dried granular detergent composition.

Each composition was tested for examining various performances such as granule strength, compression-caking, angle of repose, presence or absence of water insoluble matters and rinsing performance. A result of the test is shown in Table 1. Compression-caking was evaluated by the load (in terms of kg) required to break a test piece prepared by placing a load of 5kg on the granular detergent composition packed in a cylindrical container having an internal diameter of 10cm and a height of 15cm. The granule strength was evaluated by the degree of sinking (in terms of mm) of the granular detergent composition after packing it into a carton box for detergents (22cm × 15.5cm × 5.5cm) and shaking for 30 minutes vertically at an amplitude of 3cm; hence higher values indicate loss in granule strength.

The numerals given in parentheses for sodium citrate in the table represent the amounts of citric acid added to the slurry. In Examples 6 and 7, 5% of sodium citrate was added as citric acid while all of the sodium citrate was added as salt in Example 9. AOS in the table stands for sodium α-olefinsulfonates having 14–18 carbon atoms at least 80% of which has 16 and 18 carbon atoms, AS for sodium alkylsulfonates having 12–13 carbon atoms and AES for sodium alkyl ether sulfonates having 11–15 carbon atoms and an average 3 moles ($\overline{P}$) of ethylene oxide (EO) added.

In general, granular detergent compositions should be well-balanced in various properties and should have a granule strength of 25mm or less, a compression-caking property in terms of a destroy load of 2.5kg or less, an angle of repose of about 40°–50° and no water insoluble matters. All of the compositions tabulated as Examples 1–9 in Table 1 fully satisfy these conditions.

Table 1

| Example No. Constituent | 1 | 2 | 3 | 4 | 5 | 6 | 7 | 8 | 9 |
|---|---|---|---|---|---|---|---|---|---|
| AOS (% by weight) | 5 | 7 | 12 | 5 | 12 | 12 | 12 | 5 | 7 |
| AS (% by weight) | 20 | 14 | 7 | 20 | 7 | 7 | 7 | 20 | 14 |
| AES (% by weight) | 5 | 7 | 7 | 5 | 7 | 7 | 7 | 5 | 7 |
| Sodium silicate (% by weight) | 14.8 | 14.8 | 14.8 | 14.8 | 19.4 | 13.6 | 13.6 | 14.8 | 15 |
| (Molar ratio x) | (2.8) | (2.8) | (2.8) | (2.8) | (2.5) | (2.9) | (2.9) | (2.8) | (2.8) |
| Sodium carbonate (% by weight) | 39.2 | 36.2 | 38.2 | 29.2 | 40.1 | 38.4 | 33.4 | 40.2 | 42 |
| Sodium bicarbonate (% by weight) | 0 | 5 | 5 | 10 | 0 | 0 | 0 | 0 | 0 |
| Sodium sulfate (% by weight) | 2 | 2 | 2 | 2 | 2 | 2 | 2 | 1 | 1 |
| Sodium Citrate (% by weight) | 4 | 4 | 4 | 4 | 2.5 | 10 | 15 | 4 | 4 |
| (as citric acid) | (3) | (3) | (3) | (3) | (2) | (3.8) | (3.8) | (3) | — |
| Granule strength (mm) | 20 | 21 | 25 | 20 | 20 | 20 | 20 | 20 | 25 |
| Compression-caking property (kg) | 2.2 | 2.2 | 2.0 | 2.5 | 2.5 | 2.0 | 2.0 | 2.2 | 2.5 |
| Angle of repose (degree) | 50 | 45 | 45 | 50 | 40 | 40 | 40 | 45 | 50 |
| Water insoluble matter | None | None | None | None | None | None | None | None | None |
| Rinsing | Good | Good | Good | Good | Good | Good | Good | Good | Good |

COMPARATIVE EXAMPLES 1-8

For the purpose of comparison, compositions tabulated in Table 2 were prepared and tested in the same manner as described in the foregoing Examples. A result of the tests is shown in Table 2.

Table 2

| Comparative Example No. Constituent | 1 | 2 | 3 | 4 | 5 | 6 | 7 | 8 |
|---|---|---|---|---|---|---|---|---|
| AOS (% by weight) | 2.5 | 18.5 | 12 | 12 | 12 | 5 | 5 | 7 |
| AS (% by weight) | 12 | 4 | 7 | 7 | 7 | 20 | 20 | 14 |
| AES (% by weight) | 7.5 | 4 | 7 | 7 | 7 | 5 | 5 | 7 |
| Scdium silicate (% by weight) | 14.8 | 14.8 | 14.8 | 8.8 | 28.8 | 14.8 | 15 | 15 |
| (Molar ratio x) | (2.8) | (2.8) | (2.8) | (3.2) | (2.6) | (2.8) | (2.2) | (2.8) |
| Sodium Carbonate (% by weight) | 47.2 | 42.7 | 32.2 | 49.2 | 27.2 | 44.2 | 40.0 | 37.0 |
| Sodium bycarbonate (% by weight) | 0 | 0 | 5 | 0 | 0 | 0 | 0 | 0 |
| Sodium sulfate (% by weight) | 2 | 2 | 8 | 2 | 2 | 1 | 1 | 6 |
| Sodium citrate (% by weight) | 4 | 4 | 4 | 4 | 6 | 0 | 4 | 4 |
| (as citric acid) | (3) | (3) | (3) | (3) | (4.5) | | — | (3) |
| Granule strength (mm) | 22 | 20 | 35 | 50 | 15 | 22 | 25 | 35 |
| Compression-caking property (kg) | 2.5 | 2.0 | 4.0 | 3.0 | 2.5 | 2.5 | 3.0 | 3.5 |
| Angle of repose (degree) | 70 | 45 | 65 | 45 | 40 | 60 | 60 | 60 |
| Water insoluble matter | None | None | None | None | Present | None | None | None |
| Rinsing | Good | Poor | Good | Good | Good | Good | Good | Good |

The result of the test reveals the following facts: As is evident from Comparative Examples 1 and 2, the amount of AOS (α-olefinsulfonate) less than the specified amount incurs undesirable increase in the angle of repose while the amount of AOS greater than the specified results in the such a disadvantage that the detergent composition is not rinsed off readily. Neither of these case is undesirable. Comparative Example 3 shows that when the amount of sodium sulfate is more than 4%, the quality of the detergent composition considerably deteriorates with all of the angle of repose, the compression-caking property and the granule strength being worse than is desired. Comparative Examples 4 and 5 show that when the amount of sodium silicate is less than 10%, the granule strength is reduced and that when the amount exceeds 20%, the solubility becomes poor and undesirable water-insoluble matters are formed. Comparative Example 6 shows that when the treatment with citric acid is not applied, the angle of repose is undesirably increased. Comparative Example 7 shows that when sodium citrate is added as such to the composition, the powder characteristics are not fully improved. Comparative Example 8 shows that when the amount of sodium sulfate is too large, the granule strength is reduced and the angle of repose is undesirably increased, thus incurring deterioration of the powder characteristics.

What is claimed is:

1. A granular detergent composition which consists essentially of:

(a) from 20 to 35% by weight of anionic surfactants are selected from the group consisting of a sodium, potassium or magnesium salt of an α-olefinsulfonic acid, in which the α-olefin moiety has 12 to 20 carbon atoms, a sodium, potassium or magnesium salt of an alkyl ether sulfuric acid, in which the alkyl group has 8 to 18 carbon atoms and the average molar ratio of ethylene oxide is 1 to 5 moles per mole, and a sodium, potassium or magnesium salt of an alkylsulfuric acid, in which the alkyl group has 9 to 16 carbon atoms, from 15 to 50% by weight of the total amount of the anionic surfactants being said α-olefinsulfonic acid salt;

(b) from 10 to 20% by weight of an alkali metal silicate represented by the formula $M_2O.xSiO_2$, where M is an alkali metal and x is a number in the range from 2.5 to 3.6, (c) from 25 to 60% by weight of an alkali metal carbonate, (d) from 1 to 20% by weight of an alkali metal salt of a hydroxypolycarboxylic acid, and (e) not more than 4% by weight of an alkali metal sulfate, said composition being at least substantially free of phosphate.

2. A composition according to claim 1 wherein said alkali metal carbonate is an alkali metal carbonate, sesquicarbonate or bicarbonate or a combination thereof.

3. A composition according to claim 1 wherein said hydroxypolycarboxylate is citrate, malate, tartarate or a combination thereof.

4. A process for producing the granular detergent composition of claim 1 which comprises the steps of subjecting a slurry of said anionic surfactants, said alkali metal silicate, and said alkali metal hydroxypolycarboxylate to spray drying to form granules and adding other constituents to said slurry or the thus formed granules.

5. A process according to claim 4 wherein the content of solids comprising said anionic surfactants and said alkali metal silicate and hydroxypolycarboxylate in said slurry is 55–65% by weight.

6. The process of claim 4 wherein said alkali hydroxypolycarboxylate is formed in situ by adding a hydroxpolycarboxylic acid to a slurry of said anionic surfactants and said alkali metal silicate.

* * * * *